US006460431B1

(12) United States Patent
Chen

(10) Patent No.: US 6,460,431 B1
(45) Date of Patent: Oct. 8, 2002

(54) RATCHET TOOL

(76) Inventor: Yu Tang Chen, No. 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 09/891,398

(22) Filed: Jun. 26, 2001

(51) Int. Cl.[7] ..... B25B 13/46
(52) U.S. Cl. ..... 81/63.2
(58) Field of Search ..... 81/60, 61, 62, 81/63, 63.1, 63.2

(56) References Cited

U.S. PATENT DOCUMENTS 2,701,977 A * 2/1955 Stone ..... 81/63.2
4,770,072 A * 9/1988 Neuhaus ..... 81/63.2
5,231,903 A * 8/1993 Bockman, Jr. ..... 81/63.2
6,216,563 B1 * 4/2001 Hsieh ..... 81/63.2
6,341,543 B1 * 1/2002 Hsieh ..... 81/63.2

* cited by examiner

*Primary Examiner*—Eileen P. Morgan
*Assistant Examiner*—Joni B. Danganan

(57) ABSTRACT

A ratchet tool includes a head and a shank is connected to a neck portion of the head. A toothed member and a pawl are received in the head and the pawl is engaged with the toothed member. A passage is defined through the neck portion and a connection hole is defined in an inner periphery of the head. The passage communicates with the connection hole. A bar is movably received in the passage and has a spring connected thereto, wherein the spring urges the pawl. The pawl is shifted by pushing the bar to decide the direction that the toothed member may output a torque.

4 Claims, 15 Drawing Sheets

RATCHET TOOL

FIELD OF THE INVENTION

The present invention relates to a ratchet tool that has a bar movably received in the head of the tool and the bar shifts a pawl to have the ratchet function of the tool.

BACKGROUND OF THE INVENTION

Conventional ratchet tools known to applicant are disclosed in U.S. Pat. Nos. 5,979,274, and 6,134,990. These two tools can output a torque to tighten or, loosen an object by rotating in one direction. If the output torque is required to be applied on the opposite direction, the tool has to be used on reverse side. In other words, the tool is to be removed from the object and re-mounted to the object on its reverse side. Obviously, this cannot meet requirements of the users. U.S. Pat. Nos. 5,230,262, 5,533,427, 5,957,009, and 6,044,731 respectively disclose a tool that may output a torque in two opposite directions without removing the tool from the object.

The present invention intends to provide a ratchet tool that has a bar which is easily pushed by the user to choose the direction to be output a torque.

SUMMARY OF THE INVENTION

In accordance with one aspect of the present invention, there is provided a ratchet tool which comprises a head having a neck portion and a shank is connected to the neck portion through which a passage is defined so that a bar is movably received in the passage. The head has a through hole for receiving a toothed member therein and a recess is defined in an inner periphery of the through hole for receiving a pawl therein which is engaged with the toothed member. A connection hole is defined in an inner periphery of the recess and communicating with the the passage. The bar has a spring connected thereto which urges the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
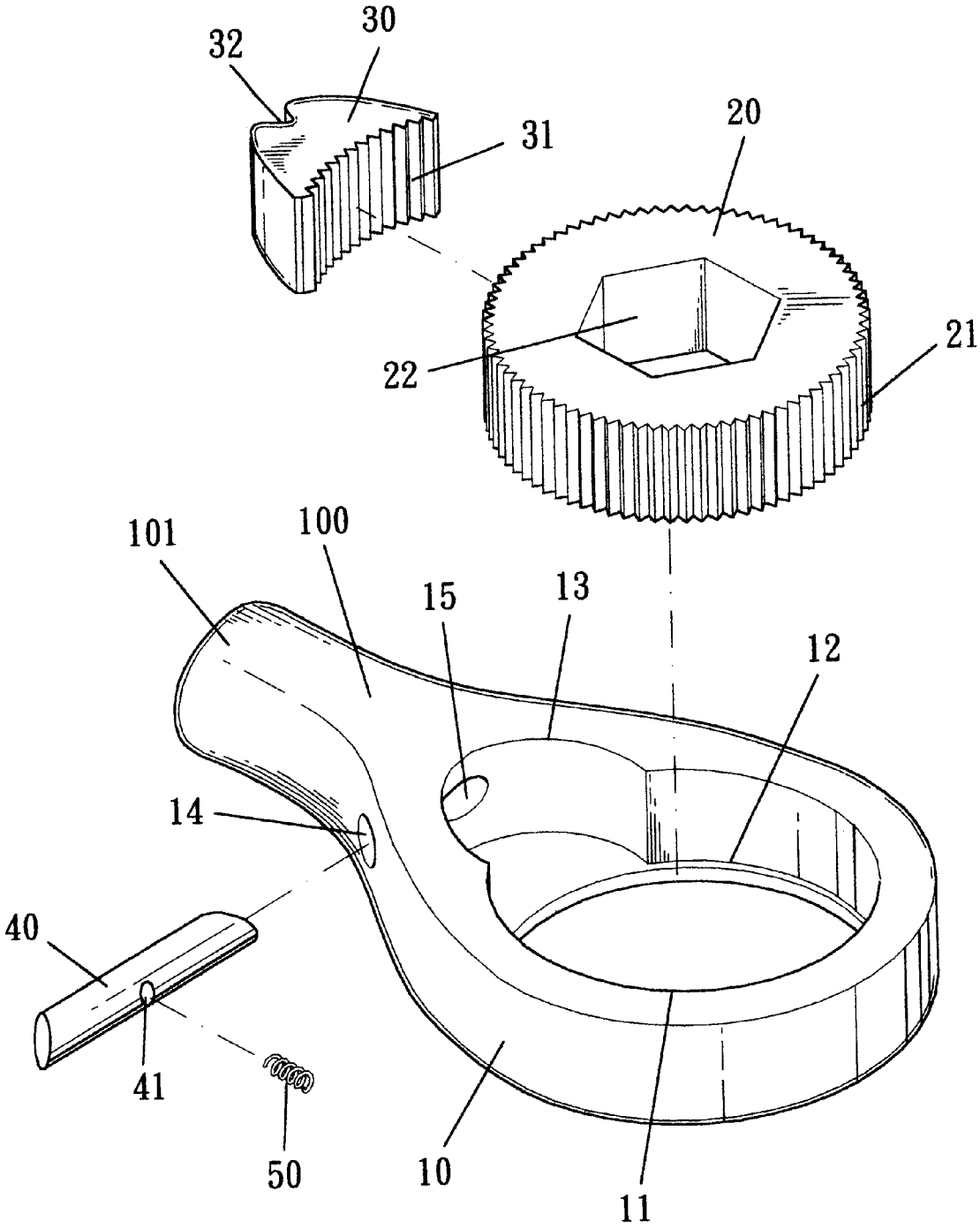
FIG. 1 is an exploded view to show a ratchet tool of the present invention.
Figure 2:
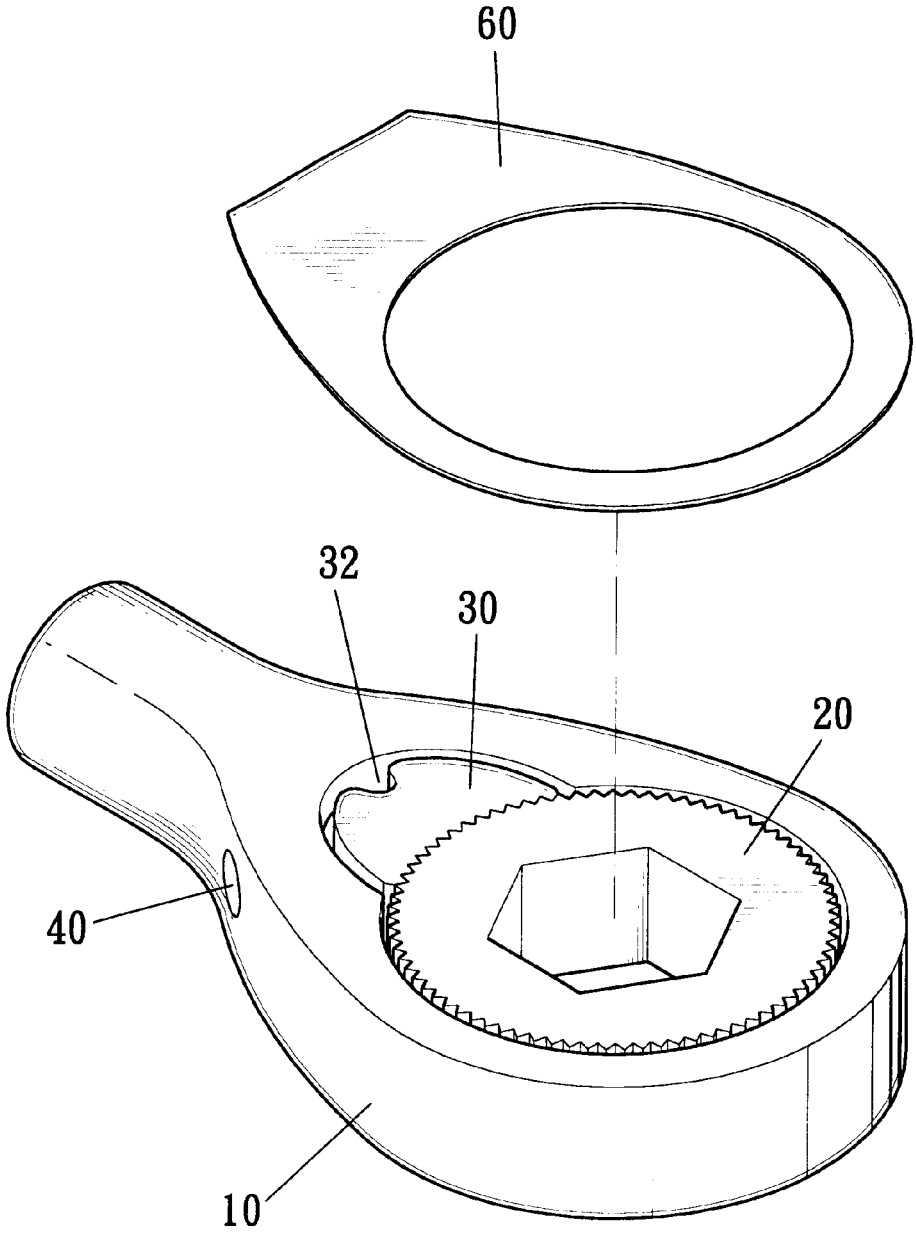
FIG. 2 is an exploded view to show a surface plate and the ratchet tool of the present invention.
Figure 3:
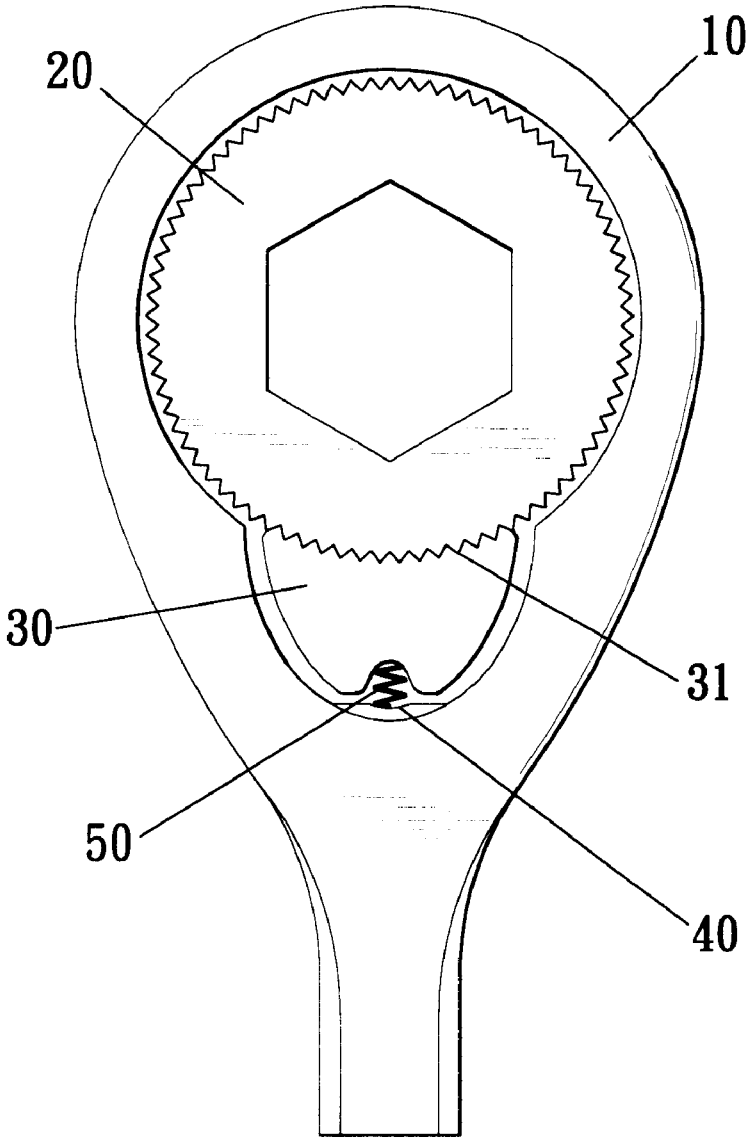
FIG. 3 is a plan view to show the ratchet tool of the present invention.

Referring to FIGS. 1 to 3, the ratchet tool of the present invention comprises a head 10 having a neck portion 100 and a shank 101 is connected to the neck portion 100. The head 10 has a through hole 11 for receiving a toothed member 20 therein and a flange 12 extends inward from an inner periphery of the through hole 11 so as to prevent the toothed member 20 from dropping from the head 10. A recess 13 is defined in the inner periphery of the through hole 11 and a pawl 30 is movably received in the recess 13. The pawl 30 has a toothed surface 31 which is engaged with the teeth 21 of the toothed member 20. The toothed member 20 has a polygonal hole 22 so as to be engaged with an object (not shown) and the pawl 30 has a notch 32.

A passage 14 is defined through the neck portion 100 and a connection hole 15 is defined in an inner periphery of the recess 13. The passage 14 communicates with the connection hole 15. The bar 40 has a recess 41 defined in an outer periphery thereof and a spring 50 is engaged with the recess 41 and is engaged with the notch 32 in the pawl 30. A surface plate 60 is connected on the head 10 to retain the parts in the head 10.

Figure 4:
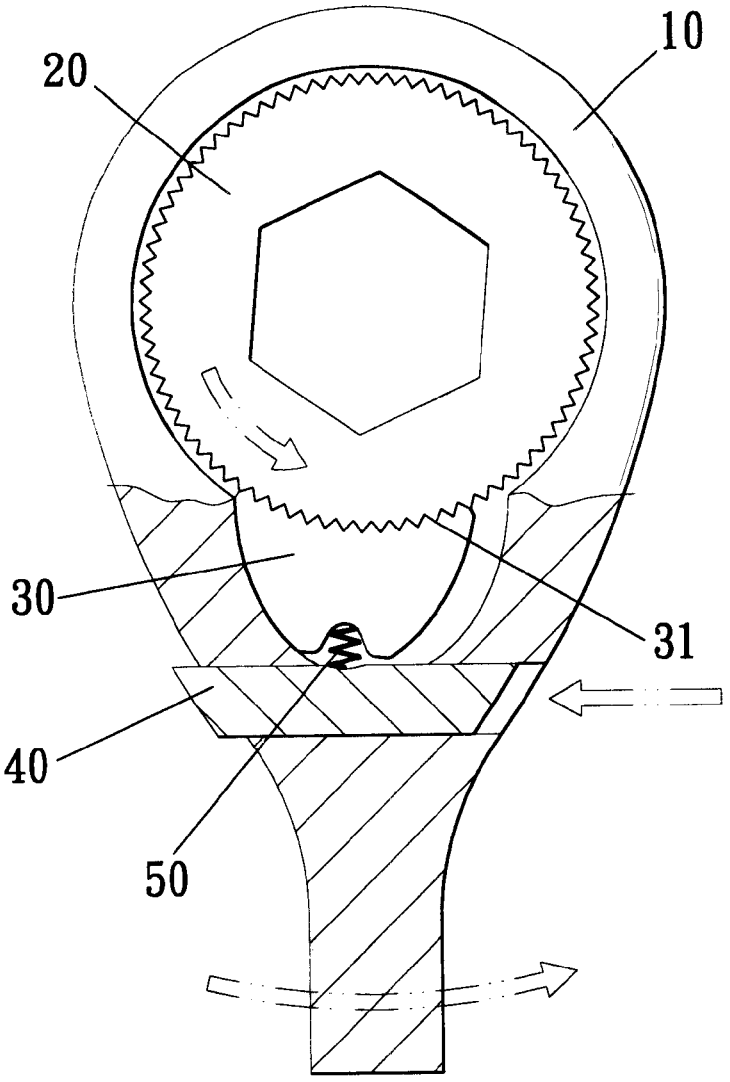
FIG. 4 is a plan view to show the ratchet tool of the present invention is rotated in one direction to output a torque.
Figure 5:
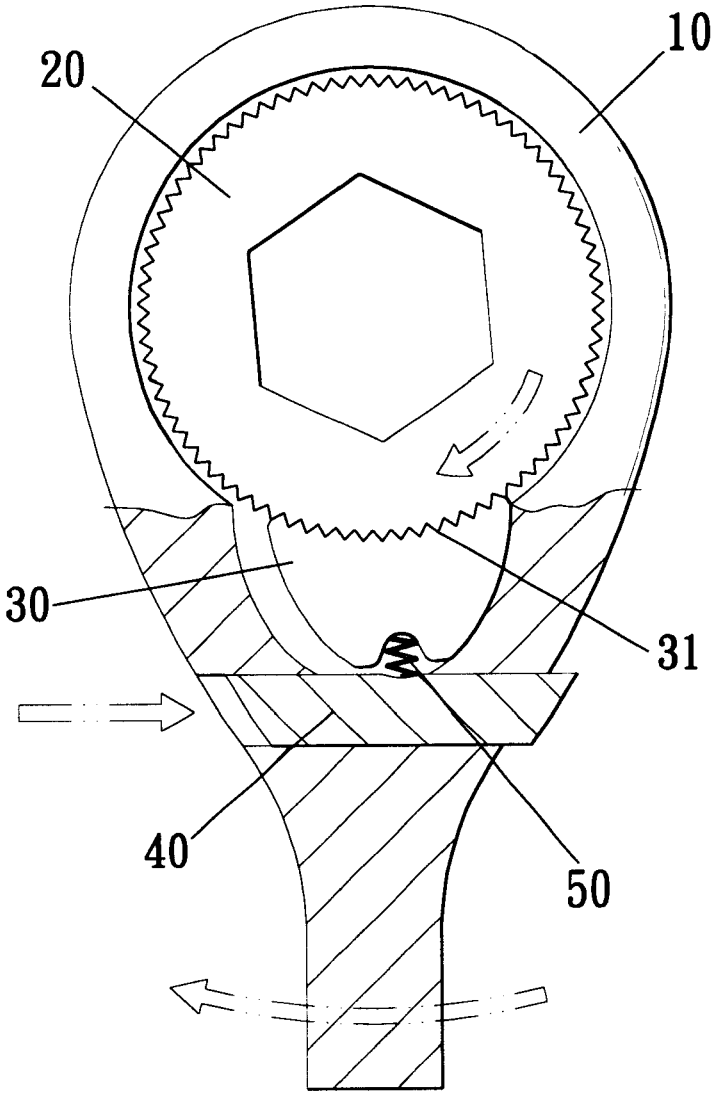
FIG. 5 is a plan view to show the ratchet tool of the present invention is rotated in the other direction to output a torque.

Referring to FIGS. 4 and 5, when pushing the bar 40, the spring 50 urges the pawl 30 to let one end of the pawl 30 contact against an inside of the recess 13. By the engagement between the two respective ends of the pawl 30 and the inside of the recess 13, the toothed member 20 can be rotated with the head 10 to output a torque in the direction illustrated by the arrow head.

Figure 6:
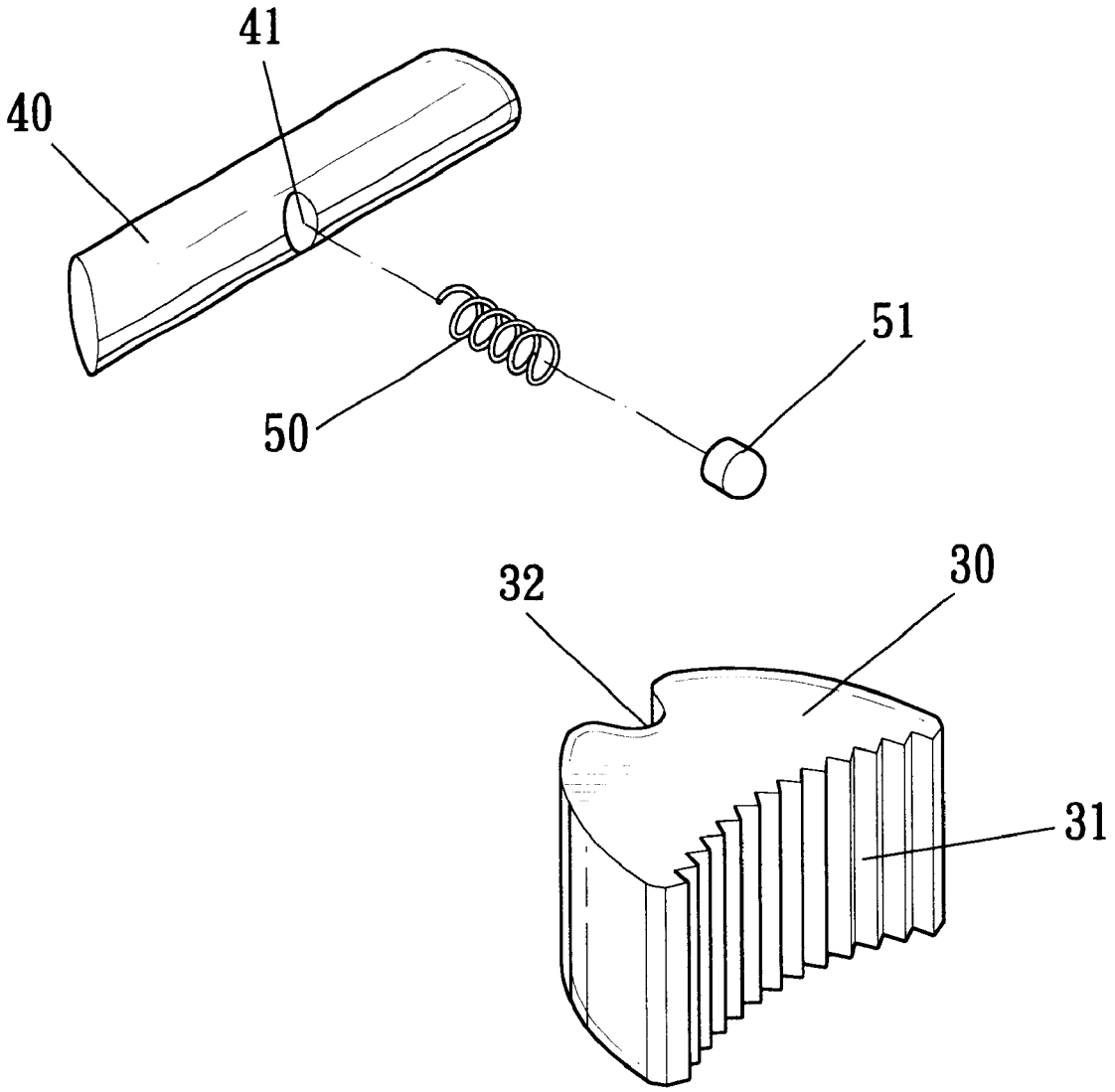
FIG. 6 is an exploded view to show an end member is connected to the spring in the ratchet tool of the present invention.
Figure 7:
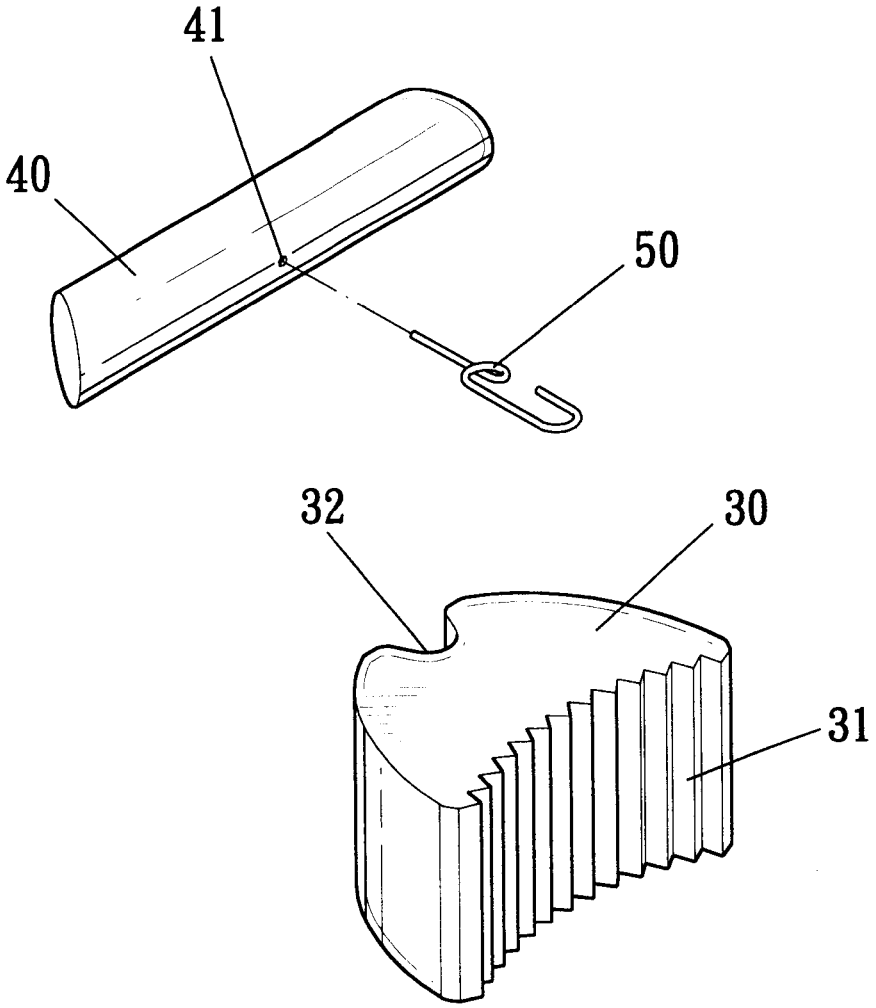
FIG. 7 is an exploded view to show another type of spring in the ratchet tool of the present invention.
Figure 8:
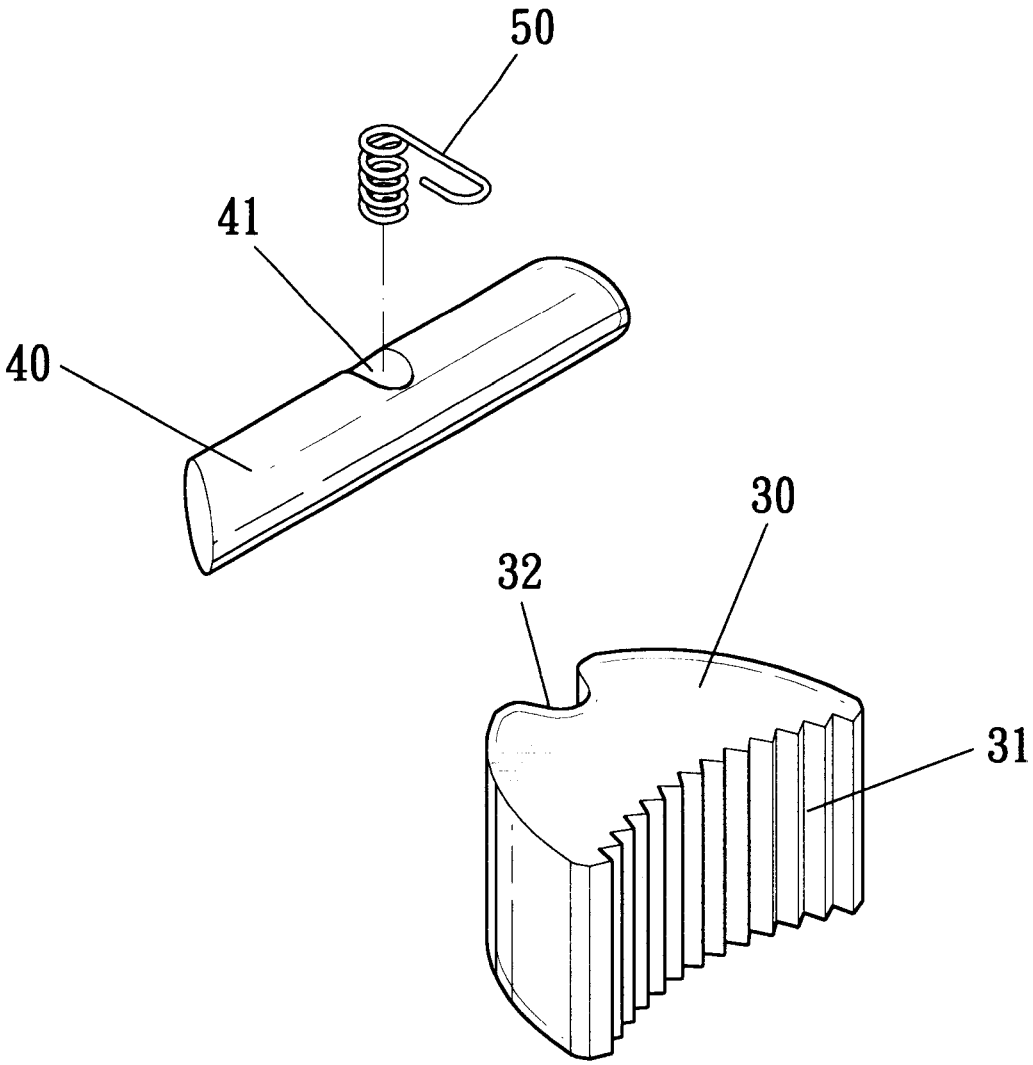
FIG. 8 is an exploded view to show yet another type of spring in the ratchet tool of the present invention.

Referring to FIG. 6, an end member 51 is mounted to an end of the spring 50 and received in the notch 32. The end member 51 has an rounded end which is perfect to be engaged with the notch 32. FIGS. 7 and 8 respectively show two different types of the spring 50 and either one of the two types of the spring 50 has an end engaged with the notch 32.

Figure 9:
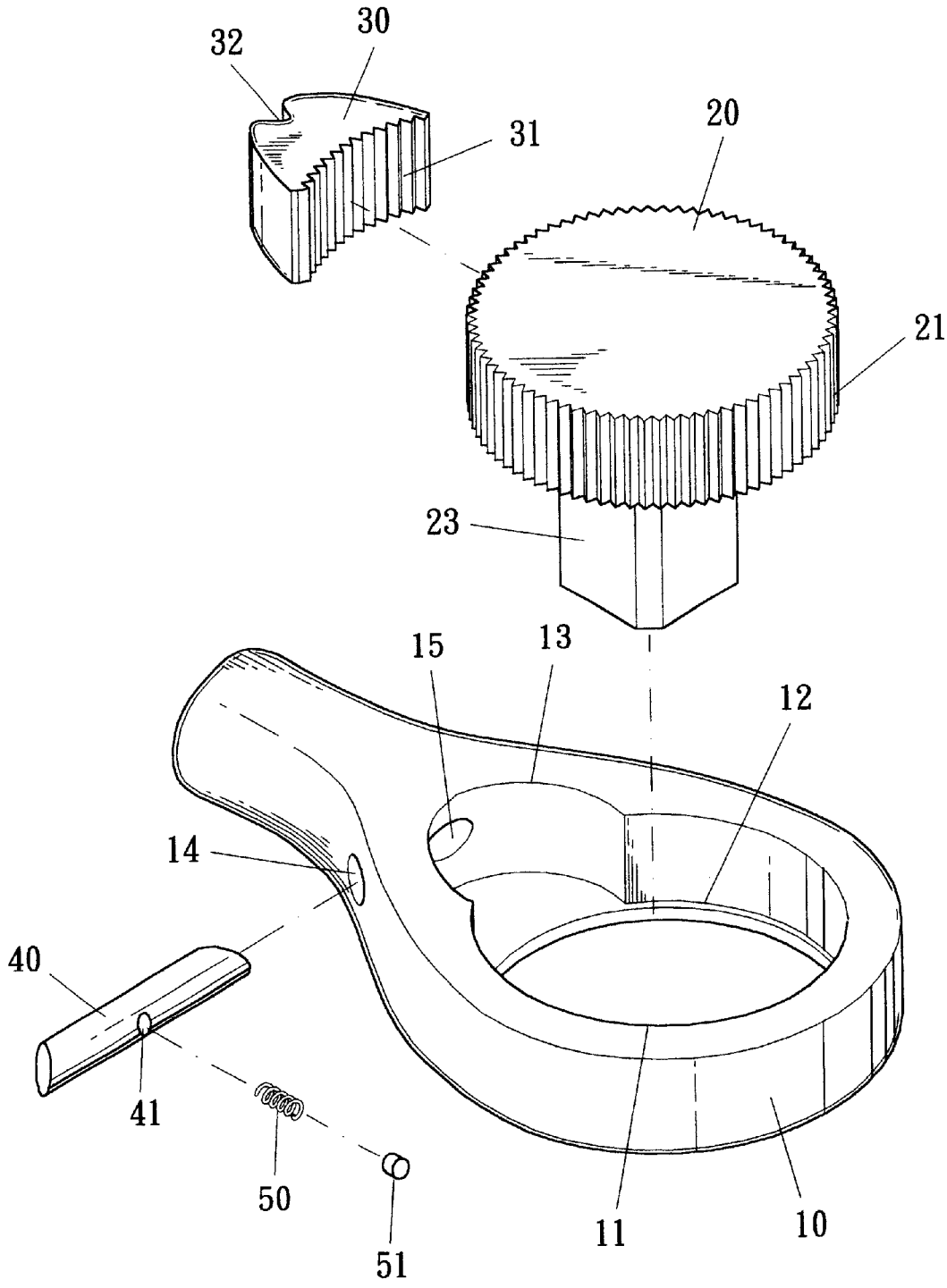
FIG. 9 is an exploded view to show that the toothed member has an engaging shaft.
Figure 10:
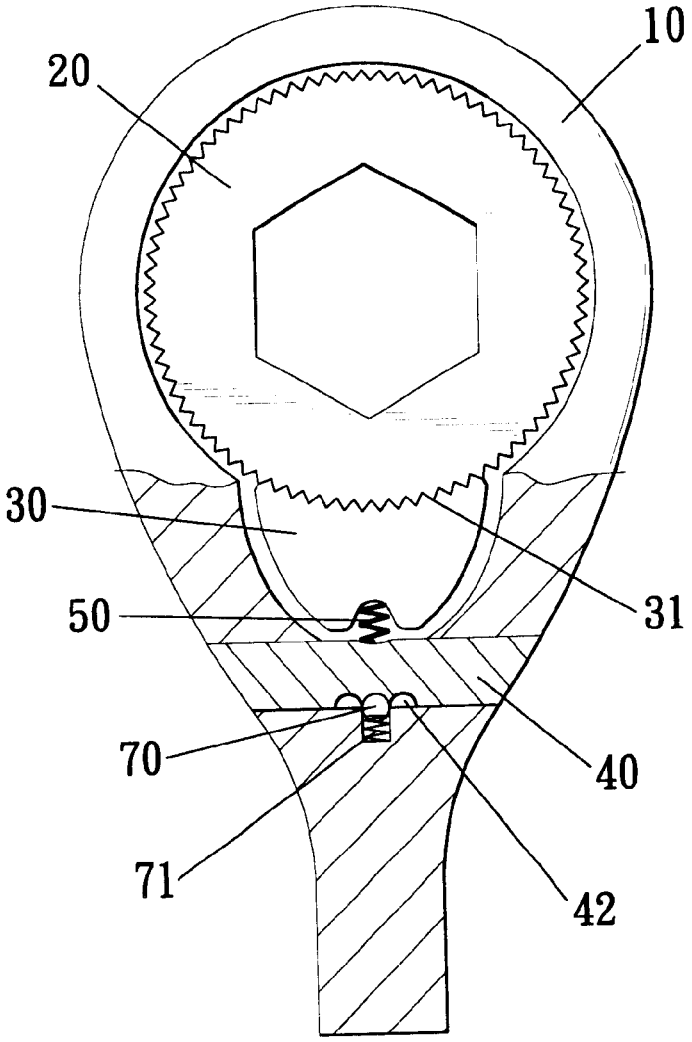
FIG. 10 shows that the bar has dents and a bead is engaged with one of the dents.
Figure 11:
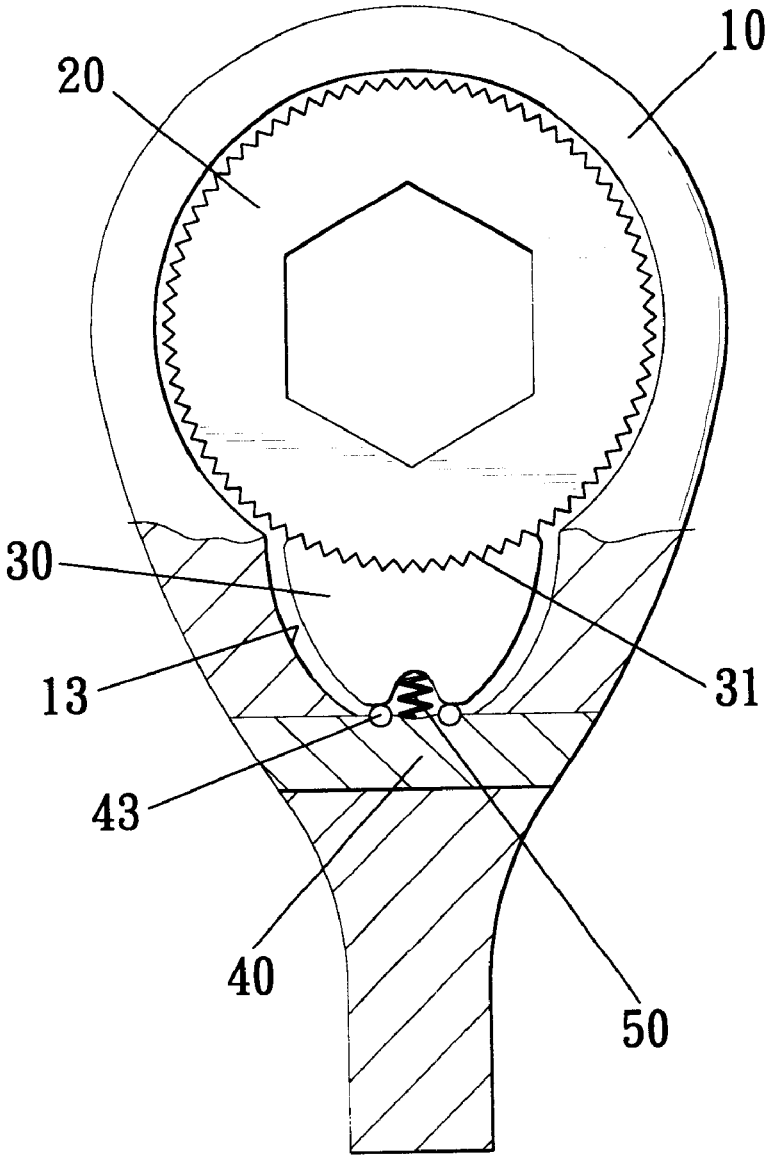
FIG. 11 is an exploded view to show that the bar has two position members.

FIG. 9 shows that the toothed member 20 has an engaging shaft 23 which extends from the head 10 so as to be engaged with a sleeve (not shown). FIG. 10 shows that the bar 40 has dents 42 defined in the outer periphery thereof and a receiving hole is defined in an inner periphery of the passage 14. A bead 70 and a spring 71 are received in the receiving hole. The bar 40 is stopped to position its position by engaging the bead 70 with one of the dents 42. FIG. 11 shows that two position members 43 are connected on the outer periphery of the bar 40 and the spring 50 is located between the two position members 43. When moving the bar 40, either one of the two position members 43 is stopped by the inside of the recess 13 so as to position the bar 40.

Figure 12:
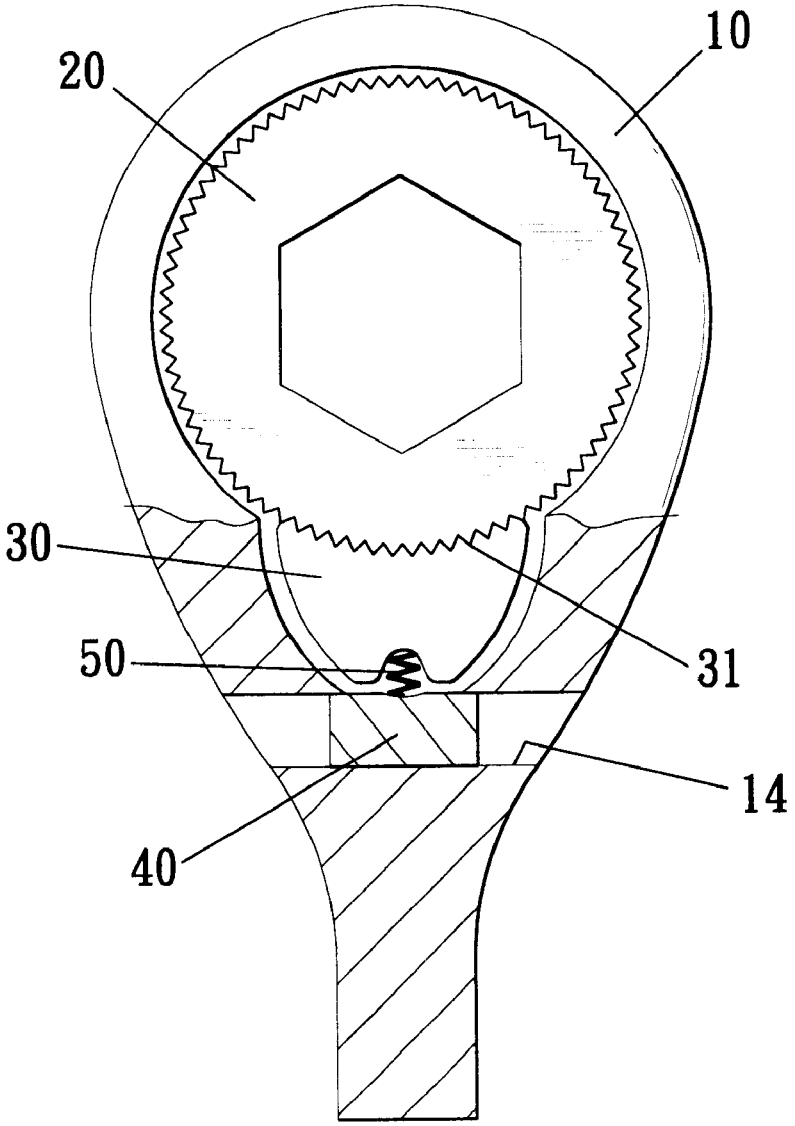
FIG. 12 is a plan view to show the bar is a short bar.
Figure 13:
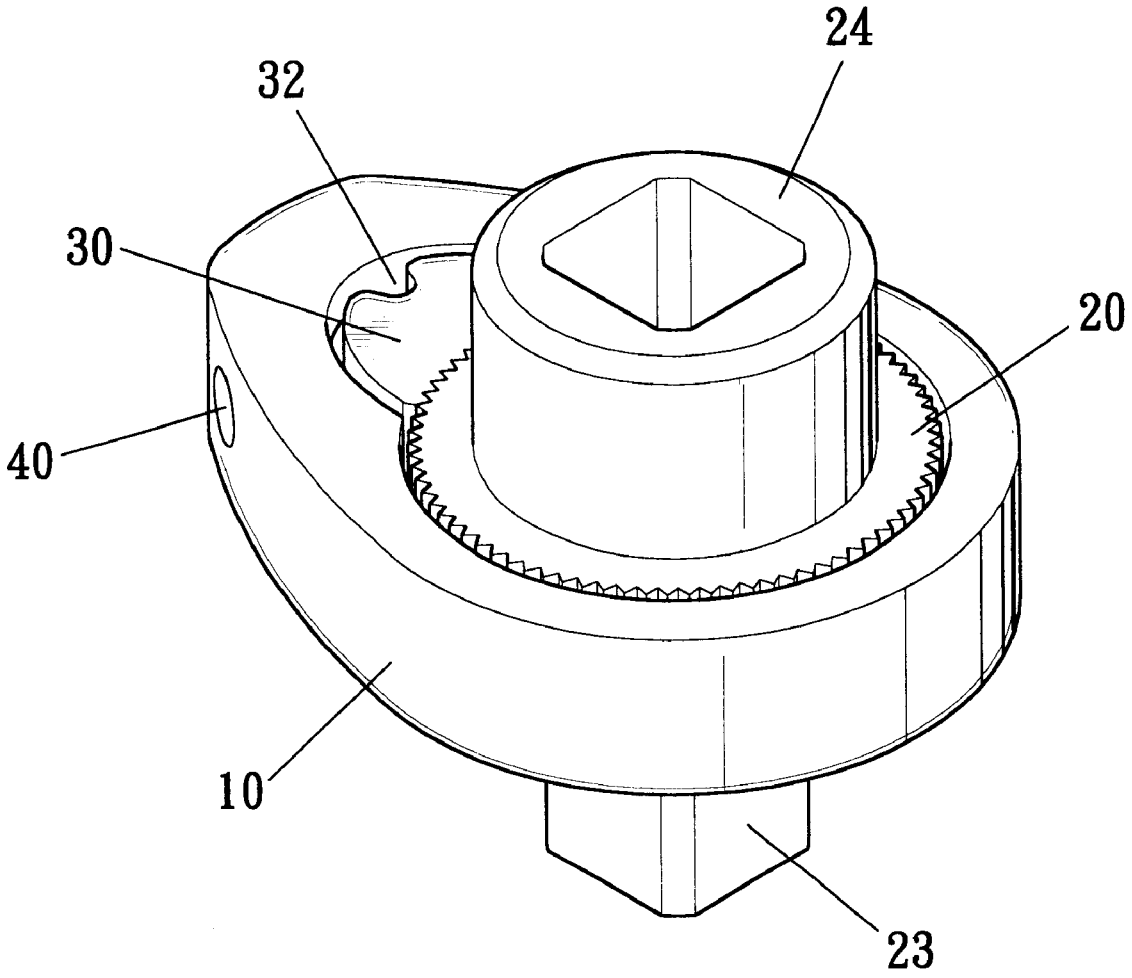
FIG. 13 is a perspective view to show the toothed member has an engaging shaft and an engaging block.
Figure 14:
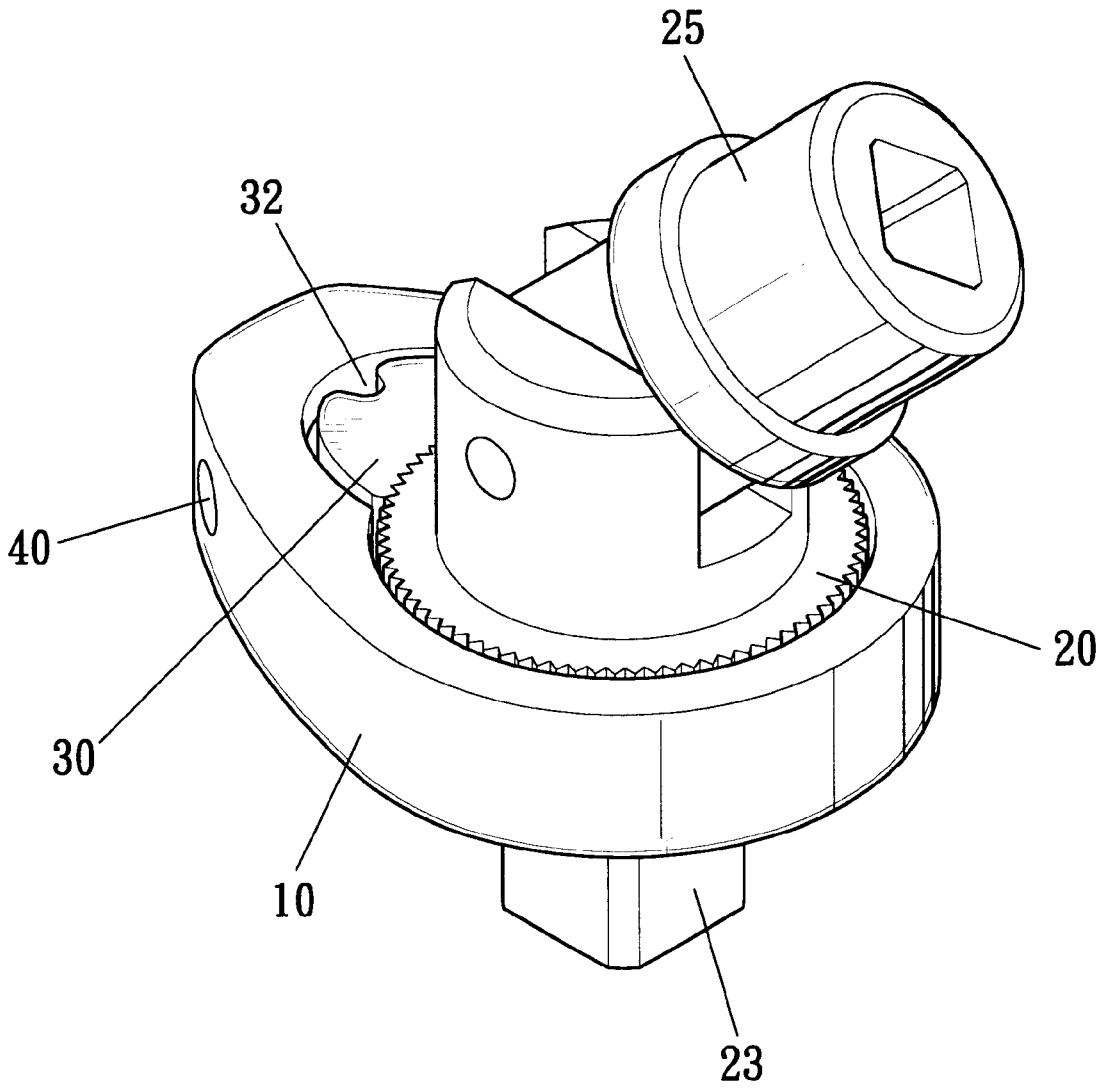
FIG. 14 is a perspective view to show the toothed member has an engaging shaft and an engaging block which is pivotally connected to the toothed member.
Figure 15:
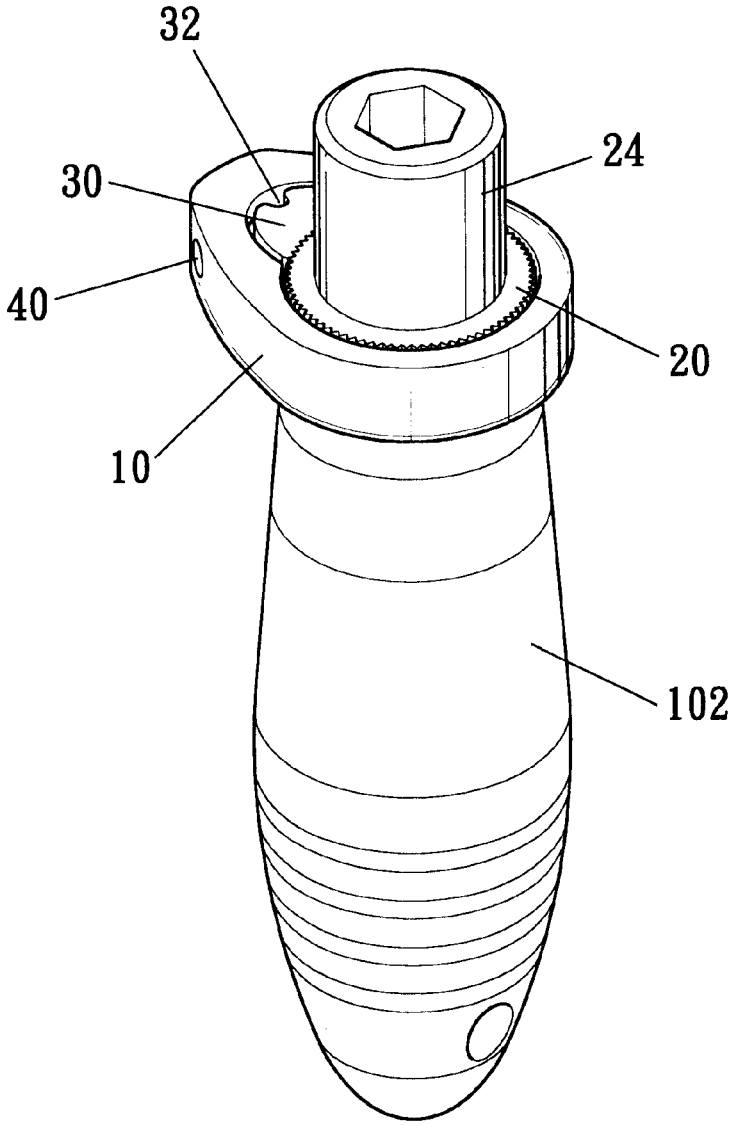
FIG. 15 is a perspective view to show the ratchet tool is connected to a handle.

FIG. 12 shows that the bar 40 is shorter than the length of the passage 14 and a lever (not shown) connected to the bar 40 can be accessed from outside of the head 10 to shift the bar 40. FIG. 13 shows that the toothed member 20 has an engaging shaft 23 and an engaging block 24, both of which respectively extend from two surfaces of the head 10. FIG. 14 shows that the toothed member 20 has an engaging shaft 23 and an engaging block 25 which is pivotally connected to the toothed member 20. FIG. 15 shows that the ratchet tool is connected to a handle 102.

While we have shown and described the embodiment in accordance with the present invention, it should be clear to those skilled in the art that further embodiments may be made without departing from the scope of the present invention.

What is claimed is:

1. A ratchet tool comprising:

a head having a neck portion and a shank connected to said neck portion, said head having a through hole for receiving a toothed member therein, a recess defined in an inner periphery of said through hole and a pawl movably received in said recess, said pawl engaged with said toothed member, a passage defined through said neck portion and a connection hole defined in an inner periphery of said recess, said passage communicating with said connection hole, and a bar movably received in said passage and having a spring connected thereto, said pawl having a notch and said spring is engaged with said notch.

2. The tool as claimed in claim 1 further comprising an end member mounted to an end of said spring and received in said notch.

3. The tool as claimed in claim 1 further comprising two position members connected on an outer periphery of said bar and said spring located between said two position members.

4. The tool as claimed in claim 1 further comprising a receiving hole defined in an inner periphery of said passage and a bead and a spring received in said receiving hole, said bar having dents defined in an outer periphery thereof and said bead engaged with one of said dents.

* * * * *